United States Patent [19]

Lookholder

[11] 4,193,499

[45] Mar. 18, 1980

[54] PREFABRICATED UNITARY PACKAGE WHICH WHEN SEALED AND IRRADIATED CONFORMS CLOSELY TO CONTENTS AND BECOMES IMPACT-ABSORBING

[76] Inventor: Theodore W. Lookholder, 1262 Barrington, Apt. 304, Los Angeles, Calif. 90025

[21] Appl. No.: 31,175

[22] Filed: Apr. 18, 1979

[51] Int. Cl.[2] ..... B65D 81/12; B65D 85/30

[52] U.S. Cl. ..... 206/524; 220/444; 229/55; 264/51

[58] Field of Search ..... 206/524, 522, 523, 387; 220/444; 229/55; 264/54, 51, 41, 45.1, 45.4

[56] References Cited

U.S. PATENT DOCUMENTS

| | | | |
|---|---|---|---|
| 2,895,603 | 7/1959 | Freeman | 206/524 |
| 2,985,287 | 5/1961 | Schulz | 206/524 |
| 3,038,593 | 6/1962 | Root et al. | 206/522 |
| 3,138,248 | 6/1964 | Abbott | 206/522 |

FOREIGN PATENT DOCUMENTS

| | | | |
|---|---|---|---|
| 2608423 | 9/1977 | Fed. Rep. of Germany | 206/387 |

*Primary Examiner*—William T. Dixson, Jr.
*Attorney, Agent, or Firm*—Robert Louis Finkel

[57] ABSTRACT

This unitary package is double-walled, the inner wall being capable of conforming to articles within the package, and the space between the walls being occupied by expandable polystyrene. After contents are sealed within the package the entire package is radio-frequency-irradiated, causing the polystyrene to expand into an impact-absorbing foam. During expansion the polystyrene forces the inner wall conformingly against the contents, and the outer wall to become generally convex outward or if constrained to assume the shape of its constraints. The result is a stiff, impact-absorbing pod whose interior surfaces closely conform to the contents.

Multilayer walls of various specified materials, and certain additives to the styrene, are provided to facilitate use of the invention.

24 Claims, 6 Drawing Figures

PREFABRICATED UNITARY PACKAGE WHICH WHEN SEALED AND IRRADIATED CONFORMS CLOSELY TO CONTENTS AND BECOMES IMPACT-ABSORBING

BACKGROUND OF THE INVENTION

1. Field of the Invention

My invention is in the field of packaging systems, and particularly relates to systems for quickly and easily preparing delicate articles for shipment.

My invention is particularly suited to situations in which the number of shipments anticipated for articles of a given type does not justify molding preformed shipping liners of impact-absorbing material such as polystyrene foam. Such situations encompass one-of-akind shipments, and also anticipated shipments of up to a few hundred units, the exact cutoff point being of course dependent upon the relative value and fragility of the items being shipped.

2. Prior Art

There are four principal forms of protection for fragile shipments: molded polystyrene containers, padded envelopes, container inserts, and loose fill.

Polystyrene containers are molded to form-fit the merchandise. They have the advantage of securing the contents snugly within an outer package, and of being crushable in event of impact, whereby the energy of impact is permanently absorbed and the contents thus protected. However, expensive molding equipment and molds are involved, and such expense can be justified only by a large number of articles to be shipped. This large number in turn requires considerable storage space for the bulky empty containers. If the containers are purchased outside the packaging facility, then shipping problems can arise because of the high bulk and low weight. Fire risk in storage and shipping can also be a problem.

Padded envelopes are either laminated pulverized paper, bonded-plastic air bubbles, or bonded-plastic foam. These envelopes are preferable only in that they need not be expensively custom-made for each article to be shipped, but they provide little or no protection against stress, strain or compression. There is generally insufficient distance between the contents and the exterior surface of the envelope, and the merchandise generally can move in at least certain directions within the envelope. In some designs, when the outer cover is punctured the padding falls away.

Container inserts are categorized in two main styles, flexible and rigid. The flexible style is a plastic foam such as flexible polyurethane or polyethylene, or a chemical which is inserted directly into the container in liquid form and chemically induced to expand to fill all the unused space with foam. Inserts in the rigid category, such as die-cut paperboard, wooden forms, and various plastic parts, act as protection. Flexible inserts are quite expensive, use excessive storage space, and are a fire hazard. In particular, the chemically-expanded liquid types require considerable skill and care of use, to protect the merchandise around all of its sides and to provide the optimum amount of material density within the package. Proper cushioning depends critically on that density, and in turn upon the amount of material placed within a container in relation to the unused space therein. As such foam remains truly flexible and resilient, it of course acts as a spring to store impact energy and later release it, rather than permanently absorbing the energy. Therefore the protective effect is limited to cushioning, that is, softening and distributing, impact—rather than permanently absorbing the impact. When the stored energy is released the resulting "second impact" within the package can sometimes be quite damaging. Rigid inserts have some of the same disadvantages of cost and storage requirements, offer little or no protection against impact at the point of support of an insert itself, and require assembly time prior to shipping.

Loose fill includes small polystyrene shapes, newspapers, excelsior, sawdust, and the like. Such fill is extremely bulky, settles in transit lessening the protection provided, constitutes a fire hazard in storage, and is time-consuming to use.

U.S. Pat. No. 3,503,177 to Kropscott et al., issued Mar. 31, 1970, describes a system for holding and cushioning fragile articles in shipment; this system involves controlled reexpansion of polystyrene beads carried and restrained within air-permeable plastic bags. The beads are first expanded in the fashion customary in the expandable-polystyrene art, and then partially collapsed, sealed in a flexibie bag, e.g. of polyethylene, that permits slow diffusion of air through its walls and into contact with the shrunken beads. As air diffuses through the walls of the bags and walls of the cells of the shrunken beads they reinflate; in the meantime the bag is placed within a container surrounding articles to be shipped, so that the reinflating particles support and protect the article. This system serves a useful purpose, but is limited in application to shipping situations wherein the initial expansion, shrinking and bagging of the styrene beads can be carried out at the same site as the final packing steps. The relatively short life of the shrunken stage of the polystyrene beads is the principal reason for this limitation. According to the disclosure of Kropscott et al., the life can be extended by providing additional, air-tight packaging of the bagged, shrunken beads; this might permit shipment of the beads in their shrunken state, subject to the necessity of maintaining each bag in an air-tight condition until within an hour of its final use. Various inconveniences and risks of such a technology will be apparent, except in relatively large-scale operations capable of justifying machinery and technicians for preparing the shrunken beads on-site just before use. In addition, the method of Kropscott et al. involves the use of additional boxing or other external containers, which must themselves be sealed and secured as separate operations after the bagged polystyrene beads are placed under and around the article to be shipped.

U.S. Pat. No. 3,667,593 to Pendleton, issued June 6, 1972, discloses a flowable packing material, used loose, consisting of multiple discrete plastic pods with air trapped within each. Closing an overfilled package presses pods in around a packed article. This art is subject to the general objections mentioned above for loose fill.

U.S. Pat. No. 2,709,856 to Hunter and Phillips, issued June 7, 1955, furnishes an example of radio-frequency power use for final preparation of a finished package. Here however the application is simply drying of yarn inside a package after liquid processing of the yarn; no cushioning material or polystyrene is involved or suggested.

U.S. Pat. Nos. 2,998,501 (Aug. 29, 1961) and 3,242,238 (Mar. 22, 1966) to Edberg and Immel, and 3,104,424 (Sept. 24, 1963) to Immel introduce methods and apparatus for making foamed polystyrene articles with radio-frequency irradiation as the means of injecting energy to heat and expand the polymer. These basic patents disclose introduction of wetting agent to the polystyrene beads from which the articles are to be made, to provide for uniform coating of a high-power-factor material (such as water) onto the beads. This in turn permits uniform heating and expansion of the polymer by a radio-frequency electric field.

U.S. Pat. No. 3,253,064 to Buonaiuto, issued May 24, 1966, discloses details of the molding process for radio-frequency heating. This patent also incidentally explains the use of a "blowing agent": this is a gas-generating substance or a fugacious liquid, also sometimes termed a "propellant," which is incorporated within the granular or bead or pellet original form of the polystyrene, and which expands the granules or beads or pellets under the application of heat by being released or thermally expanded (or both) at the same time the polystyrene is softening under the same application of heat. The pressure of the thermally expanding blowing agent expands the styrene into the desired foam structure, given only that the heat energy required to soften the resinous material and to release and expand the blowing agent is supplied—either externally generated, or generated within the polymer by radio-frequency irradiation as mentioned earlier.

None of these patents discloses or suggests a unitary prefabricated package of the character described below, or of course any of the essential refinements to such a package which are also disclosed hereunder.

BRIEF SUMMARY OF THE INVENTION

My invention is a unitary prefabricated package having captive expandable polystyrene, with a shelf life of at least two years. The polystyrene, and the entire package, are very compact in storage before use, inasmuch as the polystyrene is then unexpanded. The package is adapted to seal articles therein, and then to be irradiated as an entire unit to expand the polymer. The polystyrene is enclosed between double walls of the package, along with "blowing agent" incorporated in the polystyrene, and along with a desiccant material which acts as a reservoir of other necessary additives to the polystyrene. These additives comprise a high-power-factor material, such as water, and a surfactant which promotes uniform dispersion of the high-power-factor material through the styrene. The high-power-factor material permits irradiative heating of the polystyrene as described in the basic patents mentioned earlier, but they do not suggest use of a desiccant as reservoir; in addition the desiccant here reabsorbs these materials after completion of the expansion, to prevent subsequent degradation of the expanded polystyrene by the water or surfactant.

One component of the inner wall of the package (that is, the wall contacting the contents) is metal foil. This layer shields the contents from the radio-frequency electric field, to prevent direct heating of the contents in the event they are capable of being irradiatively heated.

Another layer of the various package walls is polyethylene film which permits conventional heat-sealing of the bag before radio-frequency heating of the polystyrene beads. The polyethylene film by sealing the contents before polystyrene expansion makes the metal-foil protecting layer operative to shield the contents from the radio-frequency field; that is to say, the polystyrene and foil act together to accomplish that objective. However, other means of sealing such as plastic staples, adhesives (hot or cold), sewing, or other non-metallic closures could also serve to bring the foil layer together to shield the contents.

Other polyethylene films isolate the metal foil layer from the contents and generally provide moistureproofing.

The polystyrene beads, desiccant and high-power-factor material, and of course the blowing agent incorporated within the polystyrene, are advantageously held within "working bags" of double-walled Mylar, with heat-sealing capabilities; the working bags are themselves sandwiched within the double walls of the package proper.

Design of the complete working bag may include expansion gussets or accordion folds to prevent tearing in event of extreme stretching around irregular parts.

After heat-sealing of the contents within the package, the entire package with contents inside is simply placed in a conventional microwave oven for a few moments.

In a variant of this method, the package may be placed within a rigid dielectric container, before irradiative heating. The rigid container acts as an external mold, causing the outer shape of the expanded package to conform to the inner shape of the rigid container when the microwave oven is turned on. Using a rectangular rigid mold, of course, produces a finished polystyrene pack whose external configuration is rectangular, and thus more readily labeled, stacked and handled.

The principles and features introduced above, and their advantages, may be more-fully understood from the detailed disclosure hereunder, with reference to the accompanying drawings, of which:

DESCRIPTION OF PREFERRED EMBODIMENTS

Figure 1:
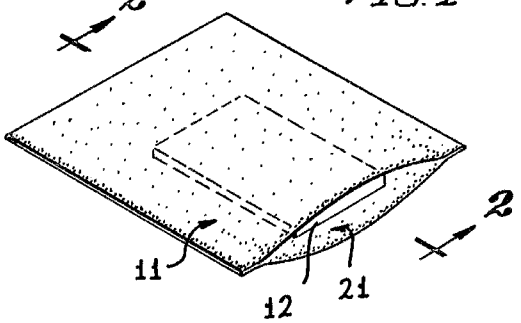
FIG. 1 is a general schematic drawing of a package made in accordance with my invention, showing partly in phantom line an article inserted into the package.

As indicated in FIG. 1 a package prepared in accordance with my invention may give the general appearance of a conventional padded bag, though somewhat thinner and slightly heavier. The package of my invention has outer and inner walls 11 and 21 respectively, and is adapted for insertion of articles 12 for protected shipment or storage.

Figure 2:
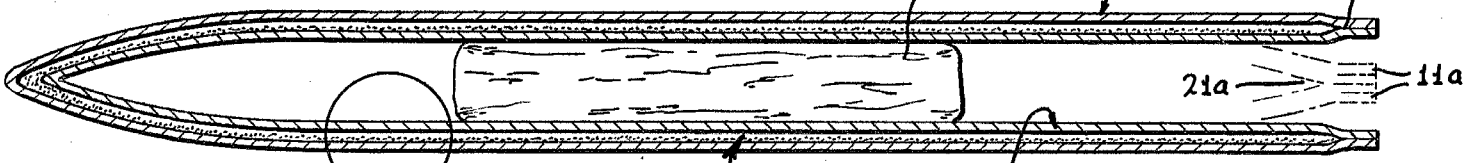
FIG. 2 is a cross-sectional drawing taken along the line 2—2 of FIG. 1, showing the package open as in FIG. 1 and also showing in phantom line the package with its principal opening sealed—but, in both instances, the polystyrene unexpanded.

FIG. 2 shows that the bag has also between walls 21 and 11 an intermediate layer 31, to be described in detail shortly. The package can be closed as suggested in the phantom line by bringing inner wall 21 together at the mouth of the container, as at 21*a*, and sealing the inner wall in that configuration by appropriate means. Of course outer wall 11 closely follows inner wall 21, as indicated at 11*a*.

Figure 3:
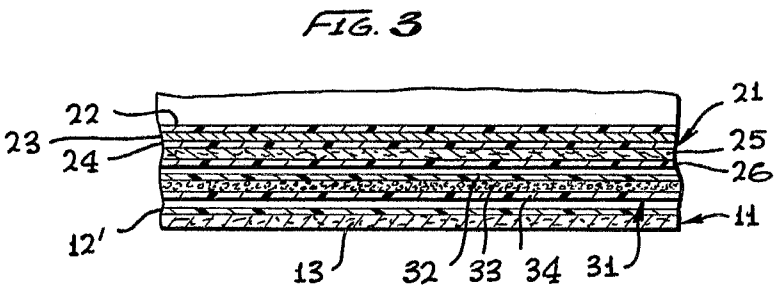
FIG. 3 is an enlarged-scale view of a small portion of the double wall of the package in FIGS. 1 and 2, specifically the portion enclosed by the curved line 3—3 of FIG. 2, and still in cross-section.

Detailed construction of the two walls and intermediate layer is indicated in FIG. 3. The outer wall 11 advantageously comprises an external covering of 100-pound kraft paper 13, backed up by a polyethylene film 12'.

The inner wall 21 has in contact with any inserted article (as at 12, FIG. 2) a polyethylene film 22, backed up by a layer of aluminum foil 23, a second layer of polyethylene 24, next a layer of 50-pound kraft 25, and finally a third (within the inner wall 21) polyethylene film 26.

Held loosely between inner and outer walls 21 and 11 is a "working bag" having Mylar walls 32 and 34, enclosing unexpanded polystyrene beads with incorporated blowing agent, and a quantity of desiccant holding water (or other high-RF-power-factor material) and surfactant—all for the purposes previously outlined.

The various polyethylene layers 12', 22, 24 and 26 have several functions. In general, all of these layers tend to assist in distributing sharp-corner stresses by the tendency of polyethylene to stretch and slide rather than catch and tear. Layer 22 as previously mentioned isolates the enclosed product 12 from the aluminum foil 23, to prevent corrosion in the latter by any moisture or other corrosives present in the former. But layer 22 also provides a simple heat-sealable joint at the outer seam 21*a* (FIG. 2). Layers 12' and 26 provide a similar joint at the prefabricated outer seam 18, and retain any moisture lost from the Mylar "working bag" 31 during heating.

Figure 4:
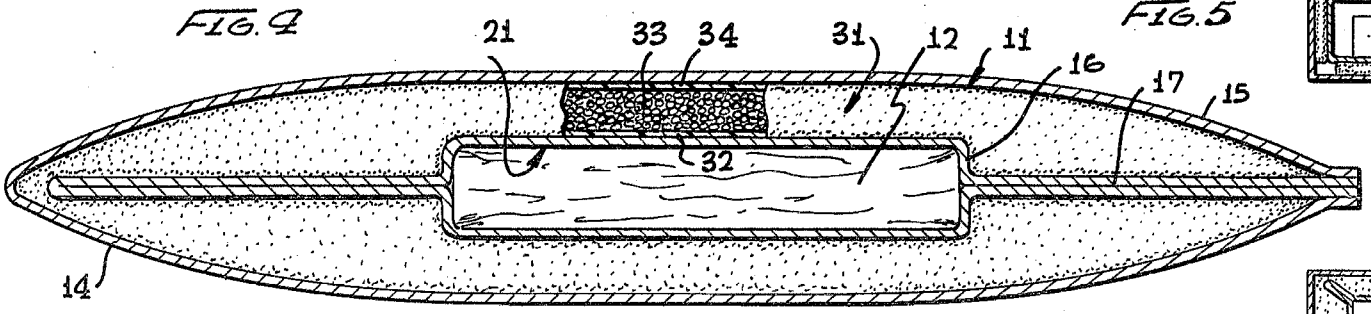
FIG. 4 is a similar cross-sectional view of the same bag and contents shown in FIG. 2, but now with the polystyrene beads expanded by heating of the entire package irradiatively as in a microwave oven.

FIG. 4 shows the package after heating in a microwave oven or equivalent radio-frequency field generator. The polystyrene particles 33 are now expanded both inward (forcing the inner wall 21 to conform sharply as at 16 to the configuration of the article 12, and where possible even to touch the opposite inner wall as at 17) and outward (producing generally arcuate or outwardly convex surfaces as at 14 and 15).

If such outward convexity is considered undesirable, the unexpanded package can be placed in a rigid dielectric form (slightly narrower and shorter than the two long dimensions of the package before expansion), and the form with enclosed package then subjected to microwave heating as before. The result will be more squared-off corners than indicated at 14 and 15 in FIG. 4, though appropriate redesign of the package itself with pleats, etc., is necessary to obtain a truly tidy-appearing rectangular package after expansion.

Figure 5:
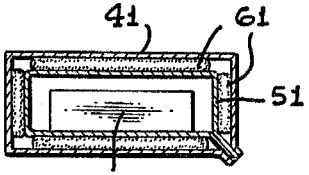
FIG. 5 is a cross-sectional view analogous to that of FIG. 2, but showing a slightly different embodiment of my invention. In this view the polystyrene beads are not expanded.
Figure 6:
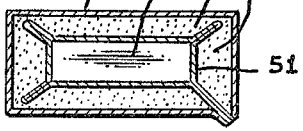
FIG. 6 is a cross-sectional view of the same package as shown in FIG. 5, but here with the polystyrene beads expanded as in a microwave oven.

Another approach to this latter goal is illustrated in FIGS. 5 and 6. Here the outer wall 41 and inner wall 51 are specifically constructed in a rectangular-box configuration, and the working bags 61 are more ample and distributed about the various six sides of the structure. This box may be heated within a rigid dielectric form, as previously mentioned, or the outer layer may comprise a stiffer outer material such as lightweight ribbed plastic. In any event the expansion of the material in the working bags 61, restrained by a separate form or by stiff walls of the box itself, acts essentially only upon inner wall 51, which then conforms closely to the shape of enclosed article 42. The outer wall 41 is constructed generally as is the outer wall 11 of FIG. 3, with the possible exception of the substituted stiffer outer material mentioned above for the 100-pound kraft 13 of FIG. 3. The inner wall 51 is constructed of the same materials as the inner wall 21 of FIG. 3, and the working bags 61 of course likewise correspond to the working bags 31 of FIG. 3.

Each finished package resulting from the prefabricated structure and method of use described herein automatically forms a snug mold around the article within and thereby prevents movement. The thick, shock-absorbing shell that forms and the absence of movement are the primary reasons for achievement of superior protection. The specifications of the microwave-activated ingredients can be varied to meet specific requirements—altering, for example, the firmness of the shell from extremely rigid to a soft, form-fitting "beanbag" effect.

It is not necessary to preexpand, age, or "condition" polystyrene beads before use in packages made in accordance with my invention. No molds or other specialized, highly expensive equipment are required with the packaging system of my invention, only a relatively inexpensive microwave oven. Shipments numbering as few as one of a kind can be cost-effectively packaged using my system. Water vapor or the like is reabsorbed after use in expanding the styrene, thereby leaving a dry pack. The article being shipped is protected from the radio-frequency radiation by the aluminum foil shield. Unused packages take very little space.

The outer cover may be of any suitable material that is strong and able to be heat-sealed. The ability to stretch a premeasured amount, as with certain plastics, would be advantageous in some applications.

While I prefer to use 100-pound kraft paper for the outer cover and 50-pound kraft paper in the inner wall, any weights of kraft paper or indeed of any suitable paper or other material may be substituted—subject to such reasonable requirements of their use as should be apparent to one skilled in the art.

In particular, both inner and outer material must be stiff enough for package use. The outer material must also be stiff enough to aid in retaining the expanding beads; the inner material must be flexible enough to comply with the object shape inside.

I prefer to use working bags of Mylar, but other material may be substituted—bearing in mind that the working bags must be strong enough to help retain and compact the beads as they expand. For the construction generally specified herein, the outer wall alone would not be sufficient to retain the expanding beads; that is, without the Mylar working bags the outer wall would rupture.

A few considerations should be mentioned as to the proportions and composition of the water or other high-power-factor material, the surfactant and the blowing agent:

The more water provided, the faster full expansion of the beads is achieved. With too little water, expansion may be inconveniently slow; with too much, expansion may become virtually explosive.

Myriad surfactants and blowing agents are available commercially, the blowing agent generally being incorporated into the polystyrene beads by their manufacturer. For surfactant I have used alkyl aryl sulfonate, sold commercially as "Nacconol 90." This material is mixed with the water, in customary proportions.

For unexpanded polystyrene beads I have used a product sold as "Arco Dylite small bead."

Innumerable quantities and proportions of materials would be usable, and I have not attempted to define the limits of usable quantities or proportions. Reference to the aforementioned U.S. Pat. No. 2,998,501, column 3 line 63 through column 4 line 20, may be helpful. I have found each of these recipes usable for one package:

| unexpanded beads (grams) | surfactant solution (grams) | desiccant (grams) |
|---|---|---|
| 30 | 30 | 30 |
| 30 | 15 | 15 |
| 30 | 15 | 0 |
| 30 | 10 | 30 |
| 30 | 2.5 | 5 |

Polyethylene film thicknesses between 0.5 and 1.5 mil have been found satisfactory.

It will be understood that the foregoing disclosure is exemplary only and not to be construed as limiting the scope of my invention, which scope is to be ascertained only by reference to the appended claims.

I claim:

1. A prefabricated unitary protective package for articles, comprising:

a container having an outer wall and a conformable inner wall and adapted to sealably enclose such articles;

the outer and inner walls being permanently presealed to each other about their mutual peripheries, defining a permanently presealed chamber between the outer and inner walls; and expandable material presealed in the chamber between the two walls and adapted to be expanded to an impact-absorbing state and thereby to force the inner wall conformingly against such articles.

2. The package of claim 1 wherein the expandable material comprises a relatively dense polymer capable of expanding to form a relatively stiff and lightweight foam.

3. The package of claim 1 wherein the expandable material comprises polystyrene beads and incorporated blowing agent.

4. The package of claim 1 wherein the expandable material is adapted to be expanded in response to application of a radio-frequency electric field.

5. The package of claim 3 wherein the expandable material is adapted to be expanded in response to application of a radio-frequency electric field, and also comprises a high-power-factor substance adapted to be distributed through the material.

6. The package of claim 5 wherein the expandable material also comprises a surfactant adapted to facilitate distribution of the high-power-factor substance uniformly throughout the material.

7. The package of claim 6 wherein the high-power-factor material comprises water.

8. The package of claim 7 wherein the water and surfactant are provided in a desiccant.

9. The package of claim 4 wherein the inner wall comprises a layer of aluminum foil to protect such articles from such radio-frequency electric field.

10. The package of claim 1 wherein the walls of the container comprise layers of polyethylene film.

11. The package of claim 1 wherein at least one wall of the container comprises a flexible covering layer suitable for packaging.

12. The package of claim 11 wherein the flexible covering layer is kraft paper.

13. The package of claim 3 wherein the material is contained within bags made of a strong, heat- and moisture-resistant substance and positioned between the inner and outer walls.

14. The package of claim 13 wherein the substance is Mylar.

15. A prefabricated unitary protective package for articles, comprising:

an inner wall adapted to conform to the shapes of such articles and comprising the following layers: a first layer of polyethylene film, a layer of aluminum foil, a second layer of polyethylene film, a layer of flexible material suitable for packaging, and a third layer of polyethylene film;

an outer wall permanently presealed to the inner wall about the mutual peripheries of the two walls, at manufacture, defining a permanently presealed chamber between the outer and inner walls, said outer wall comprising a layer of polyethylene film and a flexible covering layer of material suitable for packaging; and presealed in the chamber between the inner and outer walls a quantity of expandable polystyrene beads with incorporated blowing agent, and a quantity of water and surfactant.

16. The package of claim 15 wherein at least one of the two flexible packaging layers is kraft paper.

17. The package of claim 15 wherein the beads are enclosed within strong, heat- and moisture-resistant bags which are sandwiched between the inner and outer walls.

18. The package of claim 17 wherein the bags are made of Mylar.

19. The package of claim 15 wherein the layers within the inner wall are in a sequence which is the same as the sequence in which they are stated.

20. The package of claim 15 wherein the water and surfactant are held by a desiccant.

21. A method of packaging an article, comprising the steps of:

placing such article in a prefabricated doublewalled container having a quantity of expandable polymer permanently presealed within the double wall;

sealing the mouth of the container; and placing the container with such article sealed therein in a radio-frequency electric field to expand the polymer.

22. The method of claim 21 wherein the polymer is polystyrene with incorporated blowing agent, and has associated with it a quantity of high-power-factor material.

23. The method of claim 22 wherein the high-power-factor material is water, and the polystyrene also has associated with it a quantity of surfactant.

24. The method of claim 23 wherein the water and surfactant are provided in a desiccant which releases the water and surfactant to facilitate expansion of the polystyrene and reabsorbs the water and surfactant after expansion.

* * * * *

UNITED STATES PATENT AND TRADEMARK OFFICE

CERTIFICATE OF CORRECTION

PATENT NO. : B1 4,193,499

DATED : Jan. 19, 1993

INVENTOR(S) : Theodore W. Lookholder

It is certified that error appears in the above-identified patent and that said Letters Patent is hereby corrected as shown below:

Column 1, lines 18 and 19, "The patentability of claims 1-9, 11 and 13-24 is confirmed." should read --The patentability of claims 1-24 is confirmed.--.

Signed and Sealed this

Second Day of May, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT : B1 4,193,499

DATED : January 19, 1993

INVENTOR(S) : Theodore W. Lookholder

It is certified that error appears in the above-identified patent and that said Letters Patent is hereby corrected as shown below:

On the title page, below the inventor's name, delete "[73] Assignee: Sealed Air Corporation".

Signed and Sealed this

Twentieth Day of February, 1996

Bruce Lehman

*Attest:*

BRUCE LEHMAN

*Commissioner of Patents and Trademarks*

*Attesting Officer*

US004193499B1

REEXAMINATION CERTIFICATE (1902nd)

United States Patent [19]

Lookholder

[11] B1 4,193,499

[45] Certificate Issued Jan. 19, 1993

[54] PREFABRICATED UNITARY PACKAGE WHICH WHEN SEALED AND IRRADIATED CONFORMS CLOSELY TO CONTENTS AND BECOMES IMPACT-ABSORBING

[75] Inventor: Theodore W. Lookholder, Los Angeles, Calif.

[73] Assignee: Sealed Air Corporation

Reexamination Request:
No. 90/001,996, Apr. 11, 1990

Reexamination Certificate for:

| | |
|---|---|
| Patent No.: | **4,193,499** |
| Issued: | **Mar. 18, 1980** |
| Appl. No.: | **31,175** |
| Filed: | **Apr. 18, 1979** |

[51] Int. Cl.[5] ..... B65D 81/12; B65D 85/30

[52] U.S. Cl. ..... 206/524; 53/410; 53/414; 53/472; 220/444; 264/51

[58] Field of Search ..... 206/523, 524; 220/444; 383/2, 4; 264/41, 45.1, 45.4, 51, 54; 53/449, 472, 410

[56] References Cited

U.S. PATENT DOCUMENTS

| | | | |
|---|---|---|---|
| 2,226,617 | 12/1940 | Kuenzli . | |
| 2,344,369 | 3/1944 | Salfisberg | 383/109 |
| 2,721,691 | 10/1955 | Makrauer | 383/109 X |
| 2,895,603 | 7/1959 | Freeman . | |
| 2,985,287 | 5/1961 | Schulz . | |
| 3,038,593 | 6/1962 | Root et al. . | |
| 3,130,089 | 4/1964 | Mellinger . | |
| 3,138,248 | 6/1964 | Abbott . | |
| 3,238,599 | 3/1966 | Bauman . | |
| 3,307,318 | 3/1967 | Bauman . | |
| 3,378,864 | 4/1968 | Cornes . | |
| 3,412,521 | 11/1968 | Bauman . | |
| 3,419,134 | 12/1968 | Fitts . | |
| 3,420,363 | 1/1969 | Blickensderfer . | |
| 3,464,540 | 9/1969 | Stark . | |
| 3,503,177 | 3/1970 | Kropscott et al. . | |
| 3,613,879 | 10/1971 | Kemble . | |
| 3,734,394 | 5/1973 | Dooley | 383/109 |
| 4,030,267 | 6/1977 | Arnaud | 53/449 |
| 4,240,556 | 12/1980 | Field | 53/472 X |

FOREIGN PATENT DOCUMENTS

| | | |
|---|---|---|
| 2608423 | 9/1977 | Fed. Rep. of Germany . |
| 51-93721 | 7/1976 | Japan . |
| 51-111415 | 9/1976 | Japan . |

OTHER PUBLICATIONS

The Office Action dated Aug. 2, 1979 (3 pages).
The Amendment dated Aug. 21, 1979 (11 pages).
U.S. Pat. No. 4,193,499 issued Mar. 18, 1980 (10 pages).

*Primary Examiner*—Bryon Gehman

[57] ABSTRACT

This unitary package is double-walled, the inner wall being capable of conforming to articles within the package, and the space between the walls being occupied by expandable polystyrene. After contents are sealed within the package the entire package is radio-frequency-irradiated, causing the polystyrene to expand into an impact-absorbing foam. During expansion the polystyrene forces the inner wall conformingly against the contents, and the outer wall to become generally convex outward or if constrained to assume the shape of its constraints. The result is a stiff, impact-absorbing pod whose interior surfaces closely conform to the contents. Multilayer walls of various specified materials, and certain additives to the styrene, are provided to facilitate use of the invention.

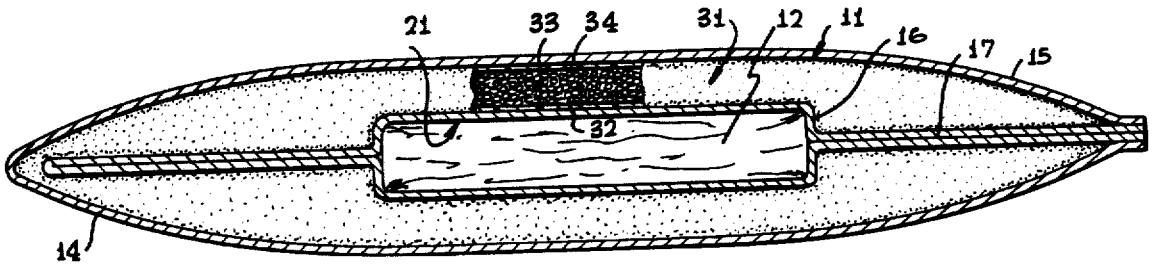

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-9, 11 and 13-24 is confirmed.

Claims 10 and 12 are cancelled.

New claims 25-34 are added and determined to be patentable.

*25. The package of claim 1 wherein the expandable material is contained within a working bag located between the inner and outer walls, the working bag having sufficient strength to retain the expandable material after it has expanded.*

*26. The package of claim 25 wherein said working bag comprises Mylar.*

*27. The package of claim 25 wherein the walls of the container comprise layers of polyethylene film.*

*28. The package of claim 25 wherein at least one wall of the container comprises a flexible covering layer suitable for packaging.*

*29. The package of claim 28 wherein the flexible covering layer is kraft paper.*

*30. The package of claim 1 wherein said outer wall is substantially less conformable than said inner wall.*

*31. A prefabricated unitary protective package for articles, comprising:*

*a container having an outer wall and a conformable inner wall;* the inner and outer walls being permanently presealed to each other about their mutual peripheries, defining a permanently presealed chamber between the outer and inner walls;

*said container having a bag-shaped configuration such that it has three closed sides and one open side with said open side being adapted to be sealed to enclose such articles; and*

*expandable material presealed in the chamber between said inner and outer walls and adapted to be expanded to an impact-absorbing state and thereby to force the inner wall conformingly against such articles.*

*32. The package of claim 31 wherein the expandable material is contained within a working bag located between the inner and outer walls, the working bag having sufficient strength to retain the expandable material after it has expanded.*

*33. The package of claim 31 wherein said expandable material is adapted to be expanded after said open side has been sealed.*

*34. The package of claim 31 wherein said outer wall is substantially less conformable than said inner wall.*

* * * * *